US009963832B2

(12) United States Patent
Han et al.

(10) Patent No.: US 9,963,832 B2
(45) Date of Patent: May 8, 2018

(54) COMPOSITION FOR SHEET USING BIOMASS, ECO-FRIENDLY COMPOSITE SHEET, AND FABRICATION METHOD FOR THEREOF

(71) Applicants: CJ Cheiljedang Corporation, Seoul (KR); Au Co., Ltd., Gyeonggi-do (KR)

(72) Inventors: Chung Ku Han, Incheon (KR); Chan Suk Yoon, Seoul (KR); Seung In Hong, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 0 days. days.

(21) Appl. No.: 14/623,810

(22) Filed: Feb. 17, 2015

(65) Prior Publication Data

US 2015/0233061 A1 Aug. 20, 2015

(30) Foreign Application Priority Data

Feb. 17, 2014 (KR) ..... 10-2014-0018004

(51) Int. Cl.

| | |
|---|---|
| ***C08L 23/00*** | (2006.01) |
| ***C08L 23/06*** | (2006.01) |
| ***C08L 23/12*** | (2006.01) |
| ***C08K 9/02*** | (2006.01) |
| ***C08K 9/12*** | (2006.01) |
| ***D21H 27/30*** | (2006.01) |
| ***D21H 17/35*** | (2006.01) |
| ***D21H 17/00*** | (2006.01) |
| ***D21H 17/67*** | (2006.01) |
| ***D21H 11/12*** | (2006.01) |

(52) U.S. Cl.

CPC ..... *D21H 27/30* (2013.01); *D21H 11/12* (2013.01); *D21H 17/35* (2013.01); *D21H 17/675* (2013.01); *D21H 17/74* (2013.01)

(58) Field of Classification Search

None

See application file for complete search history.

(56) References Cited

U.S. PATENT DOCUMENTS

| | | | | |
|---|---|---|---|---|
| 2008/0033093 | A1* | 2/2008 | Menceloglu | B82Y 30/00 524/445 |
| 2009/0311455 | A1* | 12/2009 | Bastioli | C08J 5/18 428/35.7 |
| 2010/0003434 | A1* | 1/2010 | Bastioli | C08J 5/18 428/35.2 |

FOREIGN PATENT DOCUMENTS

| | | | | |
|---|---|---|---|---|
| CN | 100999610 | A | 7/2007 | |
| CN | 101880464 | A * | 11/2010 | C08K 9/06 |
| JP | 61-034040 | | 2/1986 | |
| JP | 2002-205314 | | 7/2002 | |
| JP | 2009-510248 | | 3/2009 | |
| JP | 2012-214554 | | 11/2012 | |
| JP | 2014-25053 | | 2/2014 | |
| KR | 10-2011-0058124 | | 6/2011 | |
| KR | 10-2011-0103813 | | 9/2011 | |
| KR | 10-2011-0134987 | | 12/2011 | |
| KR | 10-2012-0047113 | | 5/2012 | |
| KR | 10-2013-0068620 | | 6/2013 | |
| WO | WO 2007/039625 | | 4/2007 | |

OTHER PUBLICATIONS

Machine translation of CN 101880464 A (no date).*
Machine translation of CN 100999610 A (No date).*
Third Office Action, Korean Application No. 2015-10084719.2, dated Feb. 13, 2018, 7 pages.
Fang, et al., Business Information Handbook, Science and Technology Press, Edition 1, Dec. 1985, 1 page.

* cited by examiner

*Primary Examiner* — Michael J Feely
(74) *Attorney, Agent, or Firm* — Swanson & Bratschun, L.L.C.

(57) ABSTRACT

The present invention provides a composition for sheet using a biomass, an eco-friendly composite sheet, and fabrication method thereof, where the sheet comprising the composition according to the present invention has eco-friendly characteristics, that is, being recyclable and not harmful to the human body. Further, the sheet according to the present invention is excellent in elongation and hardness and also has good scratch resistance.

21 Claims, 6 Drawing Sheets

COMPOSITION FOR SHEET USING BIOMASS, ECO-FRIENDLY COMPOSITE SHEET, AND FABRICATION METHOD FOR THEREOF

CROSS REFERENCE TO RELATED APPLICATIONS

This application claims priority pursuant to 35 U.S.C. 119(b) and 37 CFR 1.55(d) from Korean Patent Application No. 10-2014-0018004, filed Feb. 17, 2014, entitled "COMPOSITION FOR SHEET USING BIOMASS, ECO-FRIENDLY COMPOSITE SHEET, AND FABRICATION METHOD THEREOF," which is hereby incorporated by reference in its entirety for all purposes as if fully set forth herein.

TECHNICAL FIELD

The present invention relates to a composition for sheet using a biomass, an eco-friendly composite sheet, and a fabrication method thereof.

BACKGROUND ART

Most of the sheets currently available are made of a thermoplastic resin material using PVC as a base material. PVC, a thermoplastic resin, uses a large amount of plasticizer in order to secure ductility. Phthalate compounds, which are most widely used as the plasticizer, tend to give off endocrine disruptor that are carcinogens, while in use or disuse. Thus, the fact is that many countries all over the world have regulations on the use of the phthalate compounds. The phthalate compounds are a kind of "endocrine disruptor" that may interfere with the body's endocrine system in human and other mammals. The phthalate compounds are hazardous substances that are reported to have such toxicity as comparable to cadmium, have adverse effects on the liver, kidneys, heart, lungs, etc. as demonstrated by the results of the animal experiments and do harms to genital organs, causing female infertility and reducing sperm production, and so on.

On the other hand, as shown in FIG. 2B, Korean Patent Publication No. 1020110134987 discloses a bio-composite material "A" prepared by adding and mixing an organic natural powder, such as of jute, hemp, flax, bamboo, Cannabinaceae, sisal, rice straw, rice chaff, wood flour, green tea, etc. to a biodegradable resin "B", a petroleum-based resin, or the like and then performing an extrusion or injection molding process.

Accordingly, the inventor of the present invention completes a composition for sheet using a biomass that complies with low-carbon and eco-friendly policies and reduces the production cost by using a biomass.

DISCLOSURE OF INVENTION

It is an object of the present invention to provide a composition for sheet and its fabrication method for the purpose of fabricating a sheet that is recyclable and eco-friendly and does no harm to the human body, where the composition for sheet comprising an impregnated mixture of a porous herbaceous biomass and an nano-inorganic filler; a polyolefin resin; and a flow enhancer.

It is another object of the present invention to provide a fabrication method of an eco-friendly composite sheet, comprising: impregnating a biomass and an nano-inorganic filler to prepare an impregnated mixture; mixing the impregnated mixture with a polyolefin resin and a flow enhancer; and adding more of the polyolefin resin to the resultant composition and performing an extrusion process.

This specification specifies various exemplary embodiments with reference to the accompanying drawings. In the following description, numerous specific details, such as, for example, specific structures, compositions, processes, etc. are set forth in order to provide a full understanding of the present invention. It will be apparent, however, to those skilled in the art that the present invention can be practiced without at least one of the specific details or together with other known methods and structures. In other instances, well-known processes or preparation technique have not been described in particular detail to avoid unnecessary obscurity of the present invention. Reference throughout this specification to "an embodiment", "one embodiment", "an example" or "one example" means that a particular feature, structure, composition or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, compositions or characteristics may be combined in any suitable combinations in one or more embodiments or examples.

In one embodiment, As shown in FIG. 1B there is provided a composition for sheet that includes, with respect to the total weight of the composition, 30 to 60 parts by weight of an impregnated mixture of a porous herbaceous biomass "A" and an nano-inorganic filler; 30 to 60 parts by weight of a polyolefin resin "B"; and 1 to 40 parts by weight of a glass bead or an organic peroxide. In the embodiment, there is provided a composite for sheet, where the porous herbaceous biomass "A" is any one selected from bamboo, rice chaff, wheat bran, rice straw, wood flour and green tea. The porous herbaceous biomass "A" is pulverized into a porous powder. The porous herbaceous biomass "A" has an average particle size of 1 μm to 45 μm. The nano-inorganic filler includes at least one selected from the group including calcium carbonate, silica, mica, and talc. The nano-inorganic filler has an average particle size of 40 nm to 80 nm. The impregnated mixture is coated with a vegetable oil or a vegetable fatty acid on the surface thereof. One component in the impregnated mixture is palm oil. The polyolefin resin "B" is polyethylene resin or polypropylene resin. The glass bead has an average particle size of 3 μm to 40 μm. The organic peroxide comprises at least one selected from the group including benzoyl peroxide, 1,1-bis(t-butylperoxy)-3,3,5-trimethylcyclohexane, t-butyl peroxy acetate, t-butyl peroxy benzoate, t-butyl peroxy-2-ethyl hexanoate, t-butyl peroxy isopropyl carbonate, t-butyl peroxy neodecanoate, methylethyl ketone peroxide, and dicumyl peroxide. The composition for sheet further includes a compatibilizer or a wax.

In one embodiment, there is provided an eco-friendly composite sheet that includes: 30 to 70 parts by weight of the composition; and 30 to 70 parts by weight of a polyolefin resin. In the embodiment, there is provided an eco-friendly composite sheet, where the polyolefin resin includes at least one selected from the group including a polyethylene resin and a polypropylene resin. The eco-friendly composite sheet further includes a compatibilizer. The compatibilizer includes at least one selected from the group including polyethylene (HDPE), ethylene vinyl acetate (EVA), and linear low-density polyethylene (L/LDPE).

In one embodiment, there is provided a multi-layered eco-friendly composite sheet prepared by extruding the eco-friendly composite sheet into a multi-layered laminate.

In one embodiment, there is provided a method for preparing a composition for sheet that includes: (a) impregnating a porous herbaceous biomass and a nano-inorganic filler to prepare an impregnated mixture; and (b) mixing the impregnated mixture with a polyolefin resin and a glass bead or an organic peroxide. In the embodiment, there is provided a method for preparing a composition for sheet, where the porous herbaceous biomass is any one selected from bamboo, rice chaff, wheat bran, rice straw, wood flour and green tea. The porous herbaceous biomass is pulverized into a porous powder. The porous herbaceous biomass has an average particle size of 1 μm to 45 μm. The nano-inorganic filler has an average particle size of 40 nm to 80 nm. The impregnated mixture is coated with a vegetable oil or a vegetable fatty acid on the surface thereof. The glass bead has an average particle size of 3 μm to 40 μm. The nano-inorganic filler and the biomass are dried at 85° C. to 110° C. while mixed together. The impregnated mixture is coated at 85° C. to 110° C.

In one embodiment, as illustrated in FIG. 6, there is provided a fabrication method for an eco-friendly composite sheet that includes: (a) impregnating a porous herbaceous biomass and a nano-inorganic filler to prepare an impregnated mixture (S100); (b) mixing the impregnated mixture with a polyolefin resin and a glass bead or an organic peroxide to prepare a composition for sheet (S200); and (c) adding more of the polyolefin resin to the composition and then performing an extrusion (S300).

In one embodiment of the present invention, the term "porous herbaceous biomass" means, if not limited to, a porous powder form prepared by pulverizing a porous herbaceous plant material, such as grain hulls, straws, corn husks, barley husks, etc. The porous herbaceous biomass in powder form, as basically natural, contains water and gas and has low density. Hence, it is difficult to heat the porous herbaceous biomass up to the softening point of the other resin being compounded with the porous herbaceous biomass. It is responsible for decrease in friction coefficient since the porous natural material can easily give off heat and has a low density while being mixed with the resin. To improve this problem, the present invention may impregnate the inorganic filler to the pores in order to slightly increase the specific gravity and also reduce the amount of the gas generated during the extrusion process. Further, a surface coating agent may be used for the purpose of preventing reabsorption of water. Furthermore, a powder type red algae extract may be used to improve the properties of the biomass. In this manner, the properties of the porous herbaceous biomass can be slightly improved. For this purpose, the present invention may use 5 to 20 parts by weight of an inorganic filler, 0.5 to 3 parts by weight of a surface coating agent, and 1 to 10 parts by weight of a powder type red algae extract. The powder type porous herbaceous biomass, the inorganic filler, the surface coating agent, and the powder type red algae extract are blended together and the remainder material are impregnated in the porous herbaceous biomass by mixing at high speed, and then the resultant is coated. During the mixing process, the mixture is preferably heated up to 70° C. to 110° C. for 15 to 30 minutes to coat the powder type herbaceous biomass impregnated with the inorganic filler.

In one embodiment of the present invention, in case of resin for blow molding, the "melt flow index (MI)" of 0.05-8 is commonly used at 180° C., and in case of resin for casting, the melt flow index of 8-12 is commonly used. However, the resin for injection molding is sufficiently melted in an extruder and then cooled down by evenly dispersing into a mold of a certain shape through a gate nozzle, where the mold has a closed structure. Thus, in case of bio-plastic resin for injection molding, its melt flow index (MI) has to be higher enough than that of a general resin in order to prevent a molding failure. The reason for this is that as the bio-plastic pellet has a greater specific surface area than a general olefin-based resin, the cooling rate increases to make the inside of the mold abruptly cooled down, ending up with a molding failure. Further, the pellets including the biomass blocks a discharge of the gas generated in the space of the porous biomass, thereby the gas flow remained. As it deteriorate the marketability and properties of the final product, it is necessary to minimize the friction and reduce the generation of the gas to the minimum by improving the flowability, which is what the present invention is intended to achieve. The PP resin has a melt flow index (MI) of 25, but a PP pellet prepared using about 40 parts by weight of the powder type biomass material has a melt flow index (MI) of about 4. In this case, it may be expected that the flowability of the PP resin containing the biomass material can be improved sufficiently by using the PP resin having the greater melt flow index (MI). In reality, however, when a PP resin having a melt flow index (MI) of about 30 is used to prepare a pellet containing about 40 parts by weight of the biomass material, the pellet has a melt flow index (MI) of no more than about 10. In consideration of the fact that the PP resin used for injection molding has a melt flow index (MI) of about 20 or greater, it is thus expectedly difficult to fabricate a product using a pellet having a sufficiently high content of the biomass through an injection-molding machine. Therefore, when a resin containing biomass is used for injection molding, it is general that the used amount of the biomass material is not so high or that the biomass material can be used in an increased quantity after sufficient modification through a pretreatment process.

In one embodiment of the present invention, the term "glass bead" refers to a bead made of glass in the form of a tiny perforated spherical or cylinder body. The glass bead may be made of, if not limited to, a material well known to those skilled in the related art and have an average particle size of 3 μm to 60 μm. Further, the average particle size of the glass bead may be 2 to 5 times greater than that of the porous herbaceous biomass.

In one embodiment of the present invention, adding the flow enhancer makes it possible not only to reduce the frictional coefficient between the inner surface of the extruder and the mixture of the polyolefin resin and the porous herbaceous biomass at the melting temperature of the resin, thereby increasing the productivity, but also to prevent the porous herbaceous biomass from being carbonized in the extruder.

In one embodiment of the present invention, the inorganic filler is a substance that being impregnated in the pores of the powder type herbaceous biomass and may be a mixture of at least one or two selected from the group including calcium carbonate, glass fiber, talc, mica, silica, clay powder, wollastonite, talcum, kaolinite powder, kaolin, and titanium dioxide. When the inorganic filler is used in an extremely low content, the inorganic filler impregnated into the porous material is too less to modify the surface of the porous material to the sufficient extent and it is highly possible to have air remain in the porous material and cause problems in association with water and gas generation in the course of the process. Further, an extremely high content of the inorganic filler accounts for deterioration in the mechanical properties of the bio-plastic product in the future.

In one embodiment of the present invention, the compatibilizer is a substance that provides compatibility between the synthetic resin that is non-polar and the herbaceous biomass that is polar by eliminating ejectability between the two materials. Examples of the compatibilizer include at least one selected from the group including high-density polyethylene (HDPE), ethylene vinyl acetate (EVA), and linear low-density polyethylene (L/LDPE) and are not specifically limited to those listed above so long as they are generally used in the related art. When the compatibilizer is used in an extremely low content, interfacial delamination may occur between the synthetic resin and the herbaceous biomass because of insufficient compatibility.

Effects of Invention

The sheet including the composition according to the present invention has eco-friendly characteristics, that is, being recyclable and not harmful to the human body. Further, the sheet according to the present invention is excellent in elongation and hardness and also has good scratch resistance.

BEST MODES FOR CARRYING OUT THE INVENTION

Figure 1A:
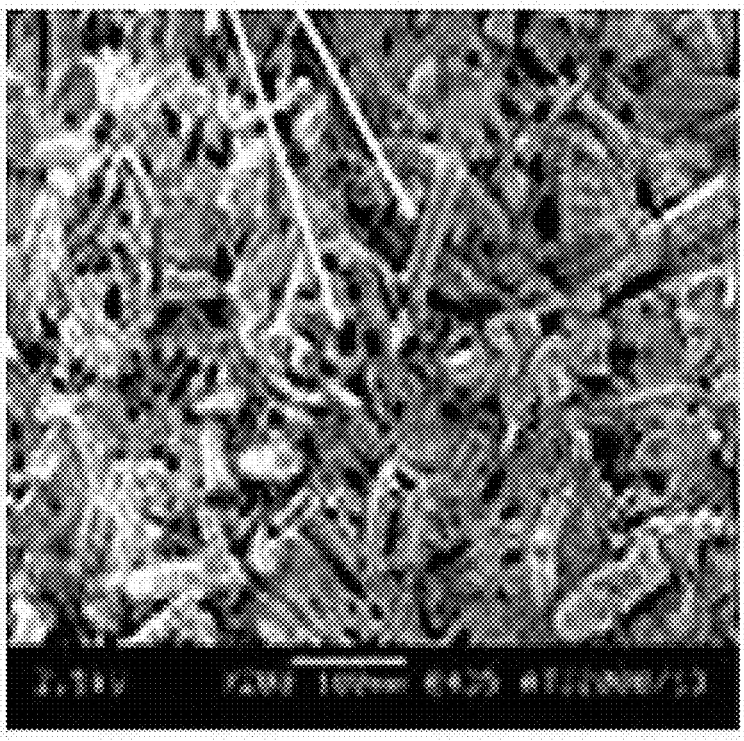
FIG. 1A is a SEM image of mixture of a porous herbaceous biomass and a polyolefin resin according to one embodiment of the present invention.
Figure 1B:
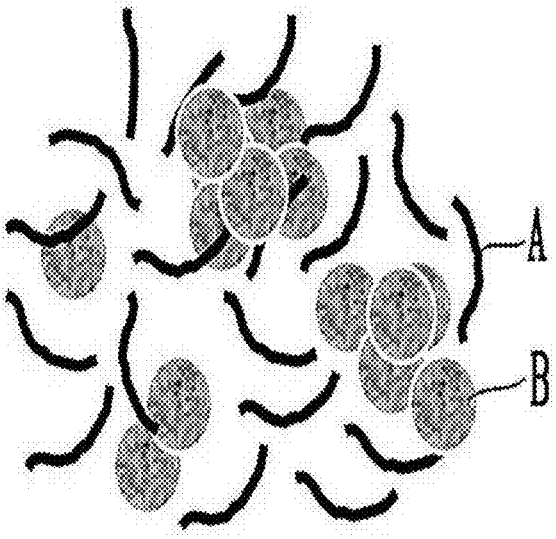
FIG. 1B is a schematic diagram showing the compatibility between the porous herbaceous biomass "A" and the polyolefin resin "B" as shown in FIG. 1A.
Figure 2A:
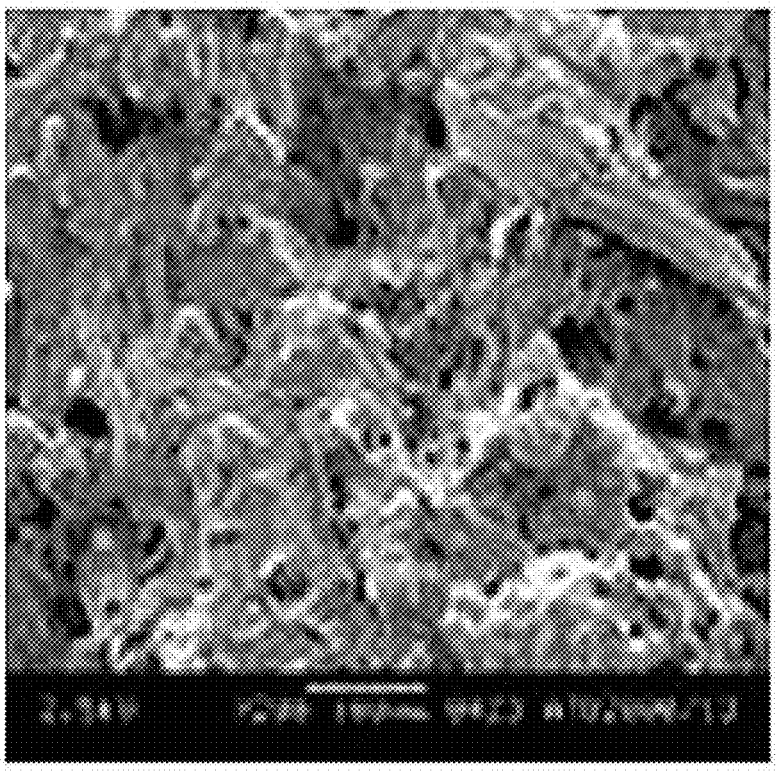
FIG. 2A is a SEM image of mixture of a porous herbaceous biomass and a polyolefin resin according to the prior art.
Figure 2B:
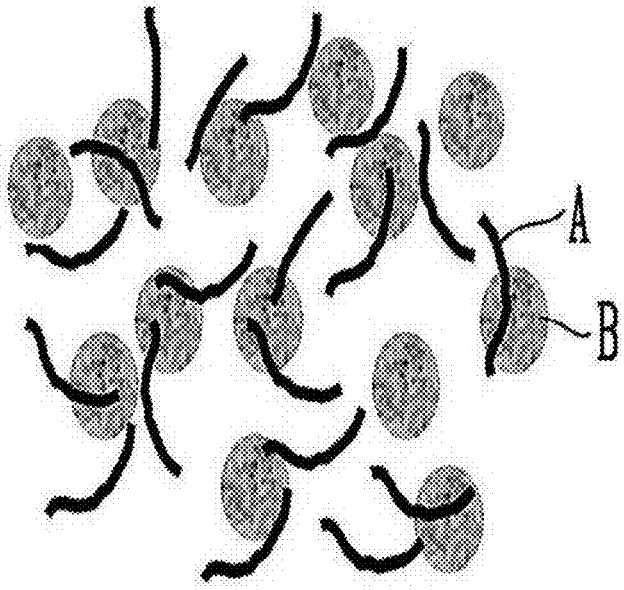
FIG. 2B is a schematic diagram showing the compatibility between the porous herbaceous biomass "A" and the polyolefin resin "B" as shown in FIG. 2B.
Figure 3:
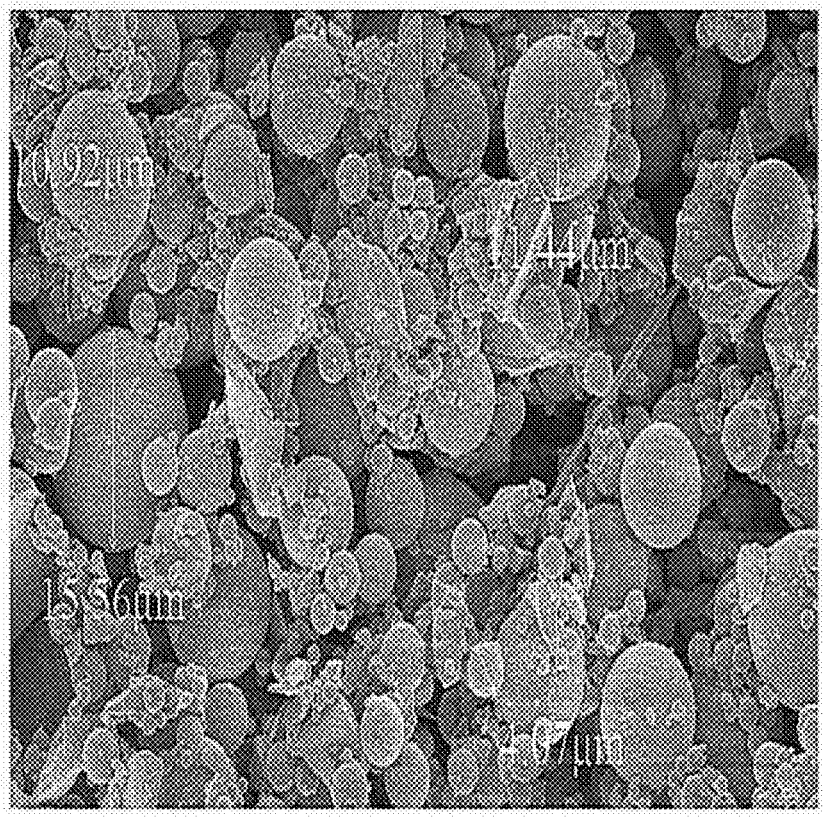
FIG. 3 is a SEM image of glass bead that is a kind of flow enhancer according to one embodiment of the present invention.
Figure 4A:
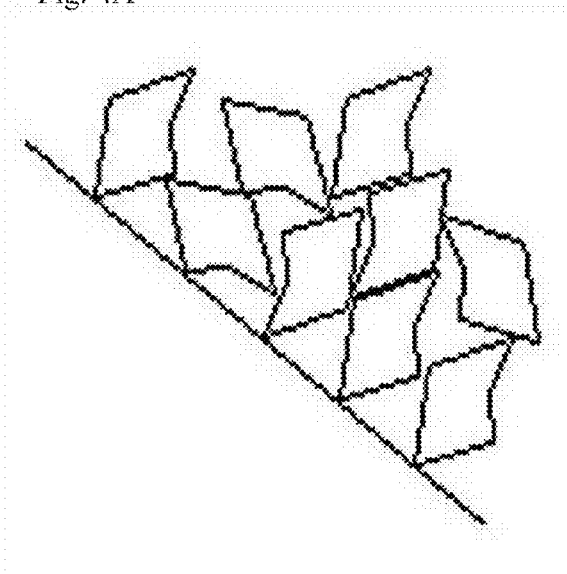
FIGS. 4A and 4B are schematic diagrams showing the principle of the effect of the glass bead added to improve the flowability of the mixture according to one embodiment of the present invention.
Figure 4B:
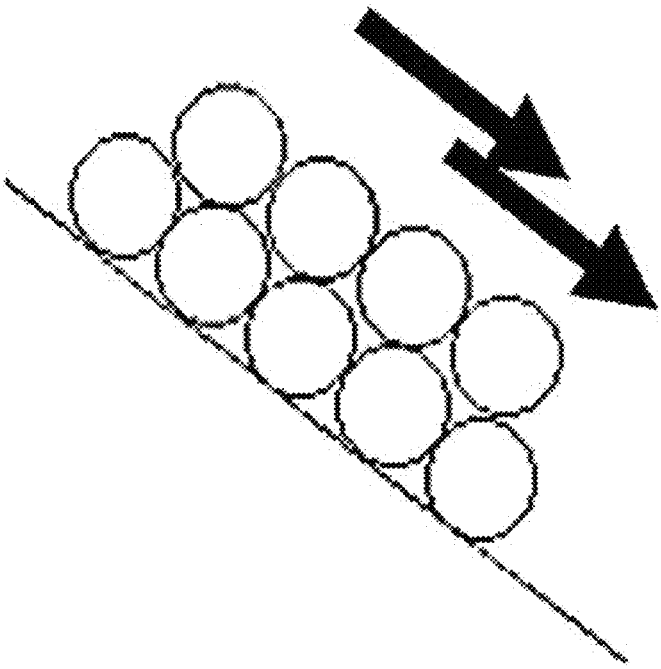

Hereinafter, a detailed description will be given as to the components and technical features of the present invention with reference to the following examples, which are given only to exemplary the contents of the present invention and not intended to limit the scope of the present invention.

Example 1

Preparation of Pretreated Biomass

Experimental Example 1

Cornhusk, a dried porous herbaceous biomass, is pulverized with a ball mill and then grind with an air-jet mill into a powder having an average particle size of 8 μm. With respect to the total weight, 40 parts by weight of the porous herbaceous biomass is impregnated with 5 parts by weight of calcium carbonate having an average particle size of 60 nm to prepare an impregnated mixture.

Experimental Example 2

Wheat bran, a dried porous herbaceous biomass, which has a particle size of 19 μm, is pulverized with a ball mill and then grind with an air-jet mill into a powder having an average particle size of 8 μm. With respect to the total weight, 40 parts by weight of the porous herbaceous biomass is impregnated with 10 parts by weight of calcium carbonate having an average particle size of 60 nm to prepare an impregnated mixture. Subsequently, 1.5 part by weight of palm oil is added as a coating agent to the impregnated mixture, which is then blended at a rate of 60 rpm in a drum dryer at 85° C. for 25 minutes to prepare a surface-coated impregnated mixture.

Comparative Example 1

Rice chaff, a dried porous herbaceous biomass, is pulverized with a ball mill and then grind with an air-jet mill into a powder having an average particle size of 8 μm. With respect to the total weight, 40 parts by weight of the porous herbaceous biomass is impregnated with 5 parts by weight of calcium carbonate having an average particle size of 60 nm to prepare an impregnated mixture.

This can be summarized as in the Table 1.

TABLE 1

| | Herbaceous biomass | nano-inorganic filler | Coating agent |
|---|---|---|---|
| Experimental Example 1 | Cornhusk, 8 μm, 40 parts by weight | Calcium carbonate, 60 nm, 5 parts by weight | ESO (Epoxidized Soybean Oil, SDB CIZER E-03, SAJOHAEPYO Corp.) |
| Experimental Example 2 | Wheat bran, 8 μm, 40 parts by weight | Calcium carbonate, 60 nm, 10 parts by weight | Palm oil, 1.5 part by weight |
| Comparative Example 1 | Rice chaff, 8 μm, 40 parts by weight | Calcium carbonate, 60 nm, 5 parts by weight | ESO(Epoxidized Soybean Oil) |

Example 2

Preparation of Composition for Sheet Including Pretreated Biomass and Evaluation of its Effects With respect to the total weight, a polypropylene resin (PP B310, manufactured by Honam Petrochemical Corp.) and PE-WAX 102N (as a wax that is a kind of lubricant for plastic) are mixed at a high speed at 85° C. in super-mixer. Subsequently, each impregnated mixture of Experimental Examples 1 and 2 and Comparative Example 1 of Example 1, respectively is added, and then a glass bead (20 nm in diameter) (Brand Name: APS20-215) as a flow enhancer and anhydrous maleic acid as a compatibilizer are added. The resultant mixture is pressurized (4 bar/3 min-cylinder retention time) and heated (190° C. to 210° C.) to prepare a composition for sheet. The specific conditions are presented in Table 2.

TABLE 2

| | PP resin | PE-WAX 102N (wax) | Impregnated mixture | Glass bead (flow enhancer) | Compatibilizer |
|---|---|---|---|---|---|
| Experimental Example 3 | 45.5 | 4 | 45 parts by weight of Experimental Example 1 | 5 | Silane, 0.5 |
| Experimental Example 4 | 39.3 | 4 | 51.5 parts by weight of Experimental Example 1 | 5 | Anhydrous maleic acid, 0.2 |
| Comparative Example 2 | 45.5 | 4 | 45 parts by weight of Comparative Example 1 | None | Silane, 0.5 |

(Unit: part by weight)

Evaluation of Melt Mass Flow (Melt Flow Index: MI)

The composition for sheet using a biomass is prepared in the same manner as described in Experimental Example 4, while the content of the glass bead having an average particle size of 3 μm to 40 μm is varied. The measurement results in regards to the melt mass flow (melt flow index (MI)) are presented in Table 3.

TABLE 3

| Sample | Glass bead (part by weight) | Test conditions Temp. (° C.)/load (g) | Results g/10 min | Method |
|---|---|---|---|---|
| Comparative Example 3 | 0 | 190/2,160 | 3.33 | ASTM D 1238 |
| Experimental Example 5 | 5 | 190/2,160 | 6.6 | ASTM D 1238 |
| Experimental Example 6 | 10 | 190/2,160 | 9.0 | ASTM D 1238 |
| Experimental Example 7 | 15 | 190/2,160 | 15.2 | ASTM D 1238 |
| Experimental Example 8 | 50 | 190/2,160 | 2.0 | ASTM D 1238 |

In this regard, the MI determination is performed according to a known method (Tinius Olsen Testing Machine Co., Inc.: MWLD-600).

According to Table 3, it is apparent that the flowability of the composition for sheet increases with an increase in the content of the glass bead. But, the flowability deteriorates when the content of the glass bead is 50 parts by weight.

Example 3

Fabrication of Eco-Friendly Composite Sheet and Evaluation of its Effects

Fabrication of Eco-Friendly Single-Layered Composite Sheet With respect to the total weight, 42 parts by weight of a polypropylene resin (PP B310, manufactured by Honam Petrochemical Corp.) and 8 parts by weight of ethylene vinyl acetate (EVA) are mixed together as a base resins, and 50 parts by weight of the composition for sheet according to Experimental Example 3 or 4 is added to the base resin mixture to prepare a composition for extrusion, which is then extruded into an eco-friendly single-layered composite sheet.

Figure 8:
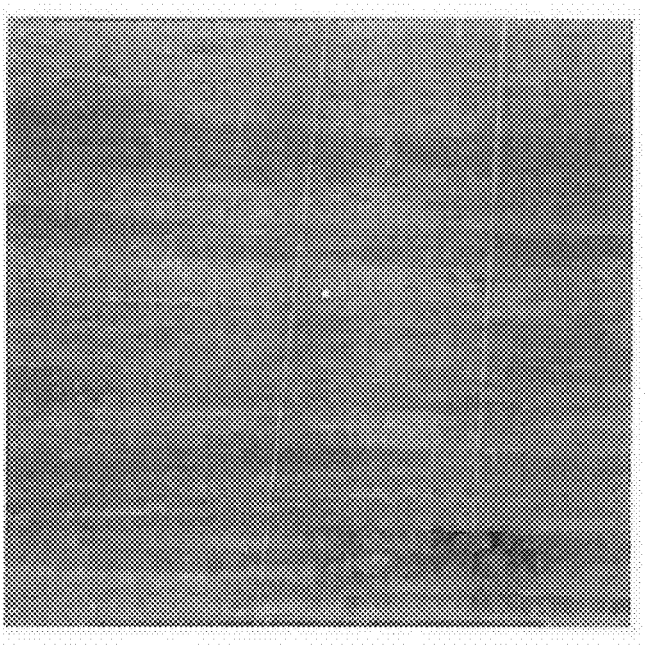
FIG. 8 shows the results of evaluation on the scratch resistance of the sheet according to another embodiment of the present invention.

The above-prepared single-layered composite sheet and a single-layered composite sheet using the composition for sheet according to Comparative Example 2 in place of Experimental Example 3 or 4 are evaluated in regards to the scratch resistance. The results of evaluation are presented in FIGS. 8 and 9, respectively. It can be seen that the composite sheets using the composition of Experimental Example 3 or 5 are superior in the scratch resistance to the composite sheet using the composition of Comparative Example 2.

Fabrication of Eco-Friendly Multi-Layered Composite Sheet

Figure 5A:
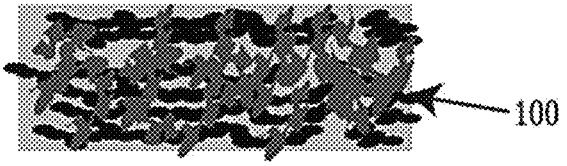
FIGS. 5A, 5B and 5C are schematic diagrams showing an eco-friendly composite sheet according to one embodiment of the present invention.
Figure 5B:
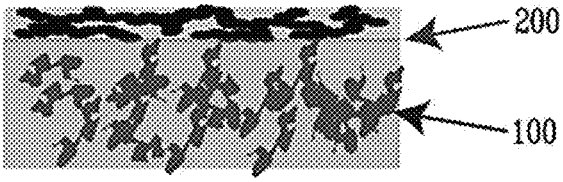
Figure 5C:
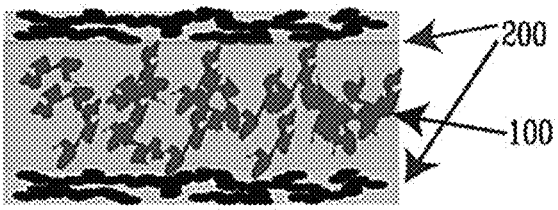
Figure 6:
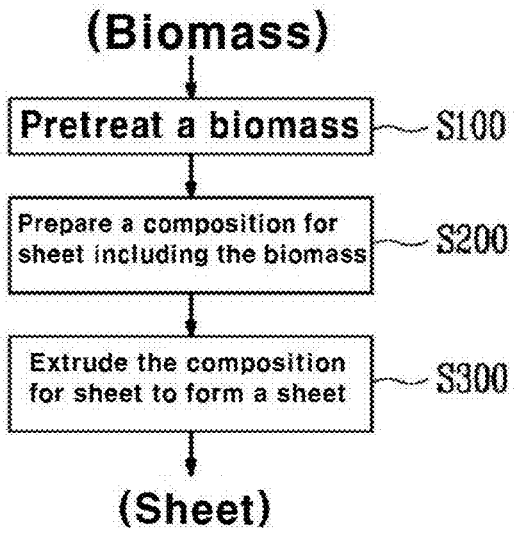
FIG. 6 is a flow chart showing a fabrication method of an eco-friendly composite sheet according to one embodiment of the present invention.
Figure 7:
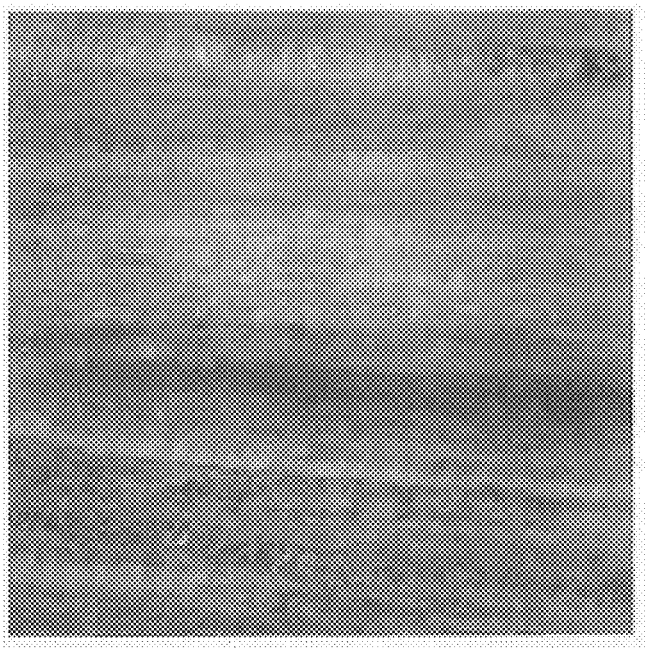
FIG. 7 shows the results of evaluation on the scratch resistance of the sheet according to one embodiment of the present invention.

With respect to the total weight, 40 parts by weight of a polypropylene resin (PP B310, manufactured by Honam Petrochemical Corp.) and 10 parts by weight of a high-density polyethylene resin (HDPE 7000F, manufactured by Lotte Chemical Corp.) are mixed together as a base resins. To the base resin mixture is added 50 parts by weight of the composition for sheet according to Experimental Example 3 or 4 to prepare a composition for extrusion, which, as is shown in FIG. 5A, is then extruded to form the first layer 100. With respect to the total weight, 35 parts by weight of a polypropylene resin (PP B310, manufactured by Honam Petrochemical Corp.) and 5 parts by weight of a linear low-density polyethylene resin (L/LDPE UL614, manufactured by Lotte Chemical Corp.) are mixed together as base resins. To the base resin mixture is added 60 parts by weight of the composition for sheet according to Experimental Example 3 or to prepare a composition for extrusion, which is then, as shown in FIG. 5B extruded to form the second layer 200. Subsequently, the first and the second layers, 100 and 200 respectively, are laminated according to the side feed block type integrated direct extrusion method to fabricate a multi-layered eco-friendly composite sheet as shown in FIG. 5C.

The multi-layered eco-friendly composite sheet is formed through the vacuum forming method to fabricate a carbon dioxide (CO2) reduced eco-friendly bio-tray. The process has no difficulty in employing the vacuum forming method, and the bio-tray thus prepared satisfies the defined properties.

The present invention has been described with reference to the particular illustrative embodiments, which are not intended to limit the scope of the present invention but susceptible to many changes and modifications without departing from the scope and spirit of the present invention. Further, specific situations and materials can be adopted in the specification of the present invention by changes and modifications without departing from the substantial scope of the present invention. The scope of the present invention is not limited to the specific embodiments disclosed as the best modes planned to realize the present invention but includes all the embodiments according to the claims of the present invention.

What is claimed is:

1. A composition for a sheet comprising:

30 to 60 relative parts by weight of an impregnated porous powder, wherein the porous powder is a pulverized herbaceous biomass, and the porous powder of pulverized herbaceous biomass is impregnated with a nano-inorganic filler;

30 to 60 relative parts by weight of a polyolefin resin; and 1 to 40 relative parts by weight of a flow enhancer.

2. The composition of claim 1, wherein the porous powder of pulverized herbaceous biomass comprises any one of bamboo, rice chaff, wheat bran, rice straw, wood flour, and green tea.

3. The composition of claim 1, wherein the porous powder of pulverized herbaceous biomass has an average particle size of 1 μm to 45 μm.

4. The composition of claim 1, wherein the nano-inorganic filler comprises at least one selected from the group consisting of calcium carbonate, silica, mica, and talc.

5. The composition of claim 4, wherein the nano-inorganic filler has an average particle size of 40 nm to 80 nm.

6. The composition of claim 1, wherein the impregnated porous powder is coated with a vegetable oil/fat or a vegetable fatty acid on the surface thereof.

7. The composition of claim 6, wherein the impregnated porous powder is coated with palm oil.

8. The composition of claim 1, wherein the polyolefin resin is polyethylene resin or polypropylene resin.

9. The composition of claim 1, further comprising compatibilizer or wax.

10. The composition of claim 1 wherein the flow enhancer comprises glass beads.

11. The composition of claim 10, wherein the glass beads have an average particle size of 3 μm to 40 μm.

12. The composition of claim 1 wherein the flow enhancer comprises an organic peroxide.

13. The composition of claim 12, wherein the organic peroxide comprises at least one organic peroxide selected from the group comprising benzoyl peroxide, 1,1-bis(t-butylperoxy)-3,3,5-trimethylcyclohexane, t-butyl peroxy acetate, t-butyl peroxy benzoate, t-butyl peroxy-2-ethyl hexanoate, t-butyl peroxy isopropyl carbonate, t-butyl peroxy neo-decanoate, methylethyl ketone peroxide, and dicumyl peroxide.

14. A method for preparing the composition for a sheet of claim 1, comprising:

pulverizing a herbaceous biomass into a porous powder;

impregnating the porous powder of pulverized herbaceous biomass with the nano-inorganic filler; and mixing 30 to 60 relative parts by weight of the impregnated porous powder with 30 to 60 relative parts by weight of the polyolefin resin and 1 to 40 relative parts by weight of the flow enhancer.

15. The method as claimed in claim 14, wherein the porous powder of pulverized herbaceous biomass comprises any one of bamboo, rice chaff, wheat bran, rice straw, wood flour, and green tea.

16. The method as claimed in claim 14, wherein the porous powder of pulverized herbaceous biomass has an average particle size of 1 μm to 45 μm.

17. The method as claimed in claim 14, wherein the nano-inorganic filler has an average particle size of 40 nm to 80 nm.

18. The method as claimed in claim 14, wherein the impregnated porous powder is coated with vegetable oil/fat or vegetable fatty acid on the surface thereof.

19. The method as claimed in claim 18, wherein the impregnated porous powder is coated at 85° C. to 110° C.

20. The method as claimed in claim 14, wherein the flow enhancer comprises a glass bead having an average particle size of 3 μm to 40 μm.

21. The method as claimed in claim 14, wherein the impregnated porous powder is dried at 85° C. to 110° C. while mixed together.

* * * * *